US006615933B1

(12) United States Patent
Eddison

(10) Patent No.: US 6,615,933 B1
(45) Date of Patent: Sep. 9, 2003

(54) DOWNHOLE TOOL WITH EXTENDABLE MEMBERS

(75) Inventor: Alan Martyn Eddison, Stonehaven (GB)

(73) Assignee: Andergauge Limited, Aberdeen (GB)

( * ) Notice: Subject to any disclaimer, the term of this patent is extended or adjusted under 35 U.S.C. 154(b) by 0 days.

(21) Appl. No.: 09/856,677

(22) PCT Filed: Nov. 19, 1999

(86) PCT No.: PCT/GB99/03872

§ 371 (c)(1),
(2), (4) Date: May 19, 2001

(87) PCT Pub. No.: WO00/31371

PCT Pub. Date: Jun. 2, 2000

(30) Foreign Application Priority Data

Nov. 19, 1998 (GB) ..... 9825425

(51) Int. Cl.[7] ..... E21B 10/32
(52) U.S. Cl. ..... 175/284; 175/267; 166/55.8
(58) Field of Search ..... 175/267, 272, 175/273, 284, 286, 384, 406; 166/55.8, 55.3

(56) References Cited

U.S. PATENT DOCUMENTS 2,112,026 A * 3/1938 Jones ..... 166/55.3
3,912,006 A 10/1975 Nutter
5,014,780 A 5/1991 Skipper
5,074,355 A 12/1991 Lennon
5,351,758 A 10/1994 Henderson et al.
5,560,440 A 10/1996 Tibbitts
5,735,359 A 4/1998 Lee et al.

* cited by examiner

*Primary Examiner*—David Bagnell
*Assistant Examiner*—Zakiya Walker
(74) *Attorney, Agent, or Firm*—Alston & Bird LLP

(57) ABSTRACT

A downhole tool (10) for mounting on a drill string comprises: a mandrel (16); a body (18) axially movably mounted on the mandrel; and radially extendable members, such as stabiliser blades or cutters (30), mounted in the body and being operatively associated with the mandrel such that relative axial movement of the mandrel and body induces radial movement of the members. Application of axial tension to the tool produces axial movement of the body relative to the mandrel, tending to retract the members from an extended configuration. The mandrel may be arranged to draw the members inwardly to permit positive retraction of the members from an extended configuration. Further, the body may define a channel (32) and the mandrel and the members include an arrangement (38, 39, 40, 42) for maintaining a desired orientation of the members relative to the body channel.

16 Claims, 3 Drawing Sheets

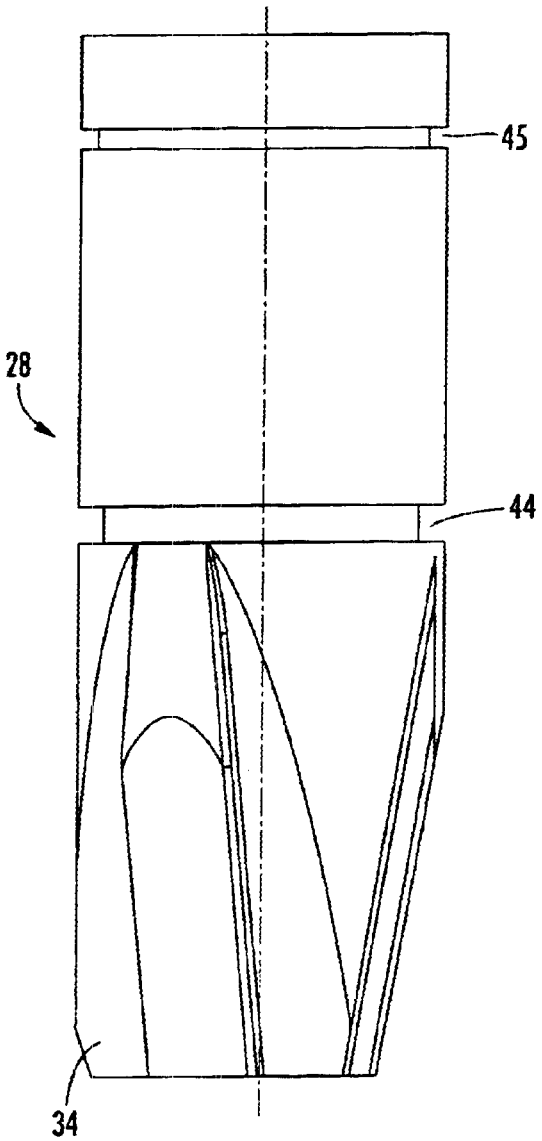
FIG. 3
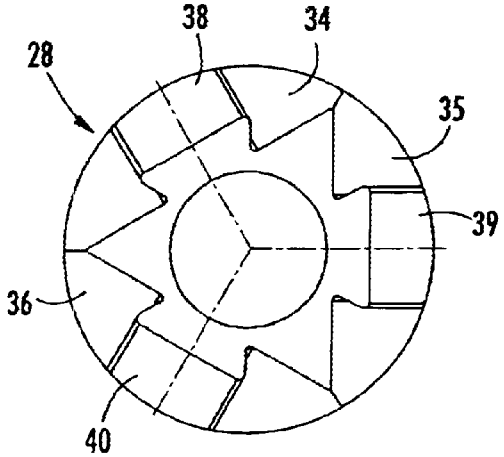
FIG. 4
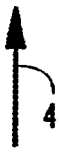

DOWNHOLE TOOL WITH EXTENDABLE MEMBERS

FIELD OF THE INVENTION

This invention relates to a downhole tool, and in particular to a tool having radially extendable members, such as an underreamer or an expandable stabiliser.

BACKGROUND OF THE INVENTION

In drilling operations, such as the drilling of bores to access subterranean hydrocarbon deposits, the drilled bores are lined with steel tubing, known as casing, which is cemented in place by pumping cement into an annulus between the casing and the bore wall. Once a length of casing is in place, this places restrictions on the diameter of any subsequent sections of bore, as drill bite and any further bore-lining casing must be able to pass through the existing casing. Clearly, reductions in bore diameter are undesirable as, for example, this limits the production flowrate of hydrocarbons through the bore.

It is known to underream beneath a section of casing to increase the bore diameter beyond the internal diameter of the casing in order to, for example, create a bore of sufficient diameter to allow a caning of outer diameter only slightly smaller than the inner diameter of the existing casing to be cemented in the underreamed bore. This is achieved by an underreaming tool which features radially extendable cutters which are initially retracted to permit the tool to be run into the bore on a drill string, and are then extended once the tool has passed beyond the end of the casing, so that drilling and underreaming may commence.

Underreamers of various forms are currently in use, though a number of existing tools have encountered some significant problems. For example, in certain situations underreamer blades have jammed in the extended configuration, such that the underreamer cannot be withdrawn through the existing casing. Of course, this prevents the drill string on which the underreamer is mounted from being withdrawn from the bore; rectifying this situation involves considerable inconvenience and expense.

It is among the objectives of embodiments of aspects of the present invention to obviate or mitigate this problem.

SUMMARY OF THE INVENTION

According to the present invention there is provided a downhole tool for mounting on a drill string, the tool comprising:

a mandrel;

a body axially movably mounted on the mandrel; and a radially extendable member mounted in the body and being operatively associated with the mandrel such that relative axial movement of the mandrel and body induced radial movement of the member, application of axial tension to the tool producing axial movement of the body relative to the mandrel tending to retract the member from an extended configuration.

The tool may take the form of an underreamer or an expandable stabiliser. For brevity, reference will be made primarily to underreamers, in which the radially extendable member will he a cutter.

This aspect of the invention facilitates retraction of the member on removal of the tool from a bore through a restriction; if the member is extended when the tool encounters a bore restriction, the member will engage the restriction and by applying tension to the string the mandrel may be lifted relative to the body and member, or vice versa, thus allowing retraction of the member.

According to another aspect of the present invention there is provided a downhole tool for coupling to a drill string, the tool comprising:

a mandrel;

a body movably mounted on the mandrel; and a radially extendable member mounted in the body and being operatively associated with the mandrel such that relative movement of the mandrel and the body induces radial movement of the member, the mandrel including means for drawing the member inwardly to permit positive retraction of the member from an extended configuration.

This aspect of the invention overcomes the difficulties associated with existing underreamers, in which the cutters may be extended by interaction between a cutter and a spring-loaded mandrel, the mandrel being movable to extend the cutter under the influence of fluid flow through the tool. In the event that the spring force, for whatever reason, is insufficient to retract the mandrel, the blades cannot be retracted.

Preferably, said means for drawing the member inwardly is in the form of an undercut groove on one of the mandrel and member and a corresponding profile on the other, which groove and profile may be of a T-slot or dovetail configuration.

According to a further aspect of the present invention there is provided a downhole tool for coupling to a drill string, the tool comprising:

a mandrel;

a body movably mounted on the mandrel and defining an channel;

a radially extendable member mounted in the body channel and being operatively associated with the mandrel such that relative movement of the mandrel and body induces radial movement of the member; and the mandrel and the member including means for maintaining a desired orientation of the member relative to the body channel.

This aspect of the present invention avoids the difficulties associated with extendable members such as underreamer cutters "cocking" or jamming in body channels or apertures from application of axial or circumferential forces to the outer parts of the cutters producing a moment on the cutter and tending to rotate the cutter in the channel; it the cutter is maintained at a desired orientation to the body such rotation is avoided or at least minimised.

Preferably, said means for maintaining a desired orientation is in the form of a groove and cooperating profile, and moat preferably an undercut groove and corresponding profile, such as a dovetail configuration.

Preferably also, the body defines an aperture to accommodate the member.

According to a still further aspect of the present invention there is provided a downhole tool for mounting between first and second sections of a drill string, the tool comprising:

a mandrel for coupling to a first section of drill string;

a body axially movably mounted on the mandrel and for coupling to a second section of drill string whereby application of weight to the string induces axial movement of the body relative to the mandrel;

fluid pressure responsive means for moving the body axially relative to the mandrel on application of a fluid pressure force between the body and mandrel; and a radially extendable member mounted in the body and being operatively associated with the mandrel such that relative axial movement of the mandrel and body induces radial movement of the member.

This aspect of the invention allows the member to be extended by one or both of weight applied to the string and by application of fluid pressure, for example by application of elevated pressure to the tool bore. Thus, using an underreamer in accordance with the invention, it is possible to ream in circumstances where an underreamer actuated only by applied weight will encounter difficulties; when drilling and reaming soft formations it may not be possible to apply sufficient weight to actuate the extendable cutters, and when "re-reaming" a section of bore it is not possible to apply weight to the string to compress an intermediate section of the string.

The first or second drill string section may take the form of a drill bit, that is the tool may be mounted on the end of a drill string and the drill bit mounted directly to the tool.

These various aspects of the present invention may be combined as desired, and a preferred embodiment of the present invention will incorporate all of the different aspects of the invention. Some preferred features of the various aspects of the invention are set out below.

Preferably, a plurality of members are provided, and most preferably the tool is provided with three members which retract and expand in unison.

Preferably also, the mandrel and body define a throughbore to permit drilling fluid to pass therethrough, and where the member is a cutter a conduit may extend from the throughbore to permit fluid to be directed towards the cutter. The conduit may be provided with a nozzle. Preferably, the throughbore is initially closed, and is opened by relative movement of the mandrel and body resulting in extension of the cutter. This prevents unnecessary loss of drilling fluid when the tool is not actuated, and the pressure drop when the conduit is opened provides an indication at surface that the cutter has been extended.

Preferably also, the mandrel and body are rotatably coupled, the coupling permitting axial movement. Most preferably, the coupling is formed of co-operating hexagonal parts, but may alternatively be defined by splined parts.

Preferably also, the mandrel defines a cam surface for co-operating with an inner face of the member. As noted above, in certain preferred aspects of the invention the faces of the mandrel and member positively engage, such that the member is positively retracted and the member orientation maintained constant as the member is extended and retracted.

Preferably also, the portion of the mandrel coupled to the drill string and the portion of the mandrel defining the cam surface are separable, and are coupled by cooperating screw threads. The portion of the mandrel coupled to the string is rotatably coupled to the body. On making up the mandrel portions, the screw thread is not fully made up, such that a degree of rotation is permitted between the mandrel portions. This prevents torque being transmitted from the string, through the mandrel to the cam surface and the member, which might otherwise result in misalignment of the can and member or misalignment between the cutter and body, and jamming of the member.

Preferably also, the mandrel and body are initially releasably fixed relative to one another, for example by means of one or more shear pins; this permits manipulation of the string without activation of the tool. In particular, where the tool is an underreamer and it is desired to drill and underreamer beneath an existing casing, it may first be necessary to drill through a casing shoe on the lower end of the casing; activation of an extendable cutter during such a drilling operation would result in damage to the existing casing. Accordingly, the casing shoe may be drilled out and the bore drilled beyond the end of the casing sufficiently to accommodate the underreamer before additional weight is applied to the string to shear the pin and activate the underreamer.

A further aspect of the invention, which may be provided separately or in combination with the other aspects described above, is the provision of one or more members, such as cutters or blades, mounted to a mandrel by dovetails or T-slots.

As used herein, the term drill string is intended to encompass any appropriate form of drill support, including drill pipe and coil tubing. Typically, the underreamers in accordance with the various aspects of the prevent invention will be mounted on the lower end of a drill string with the drill bit mounted directly to the lower end of the underreamer.

BRIEF DESCRIPTION OF THE DRAWINGS

These and other aspects of the present invention will now be described, by way of example, with reference to the accompanying drawings, in which:

FIG. 3 is an enlarged view of a cam sleeve of a mandrel of the underreamer of FIG. 1;

FIG. 4 is a view from below of the cam sleeve of FIG. 3, taken in the direction of arrow 4 of FIG. 3;

DETAILED DESCRIPTION OF THE DRAWINGS

Figure 1:
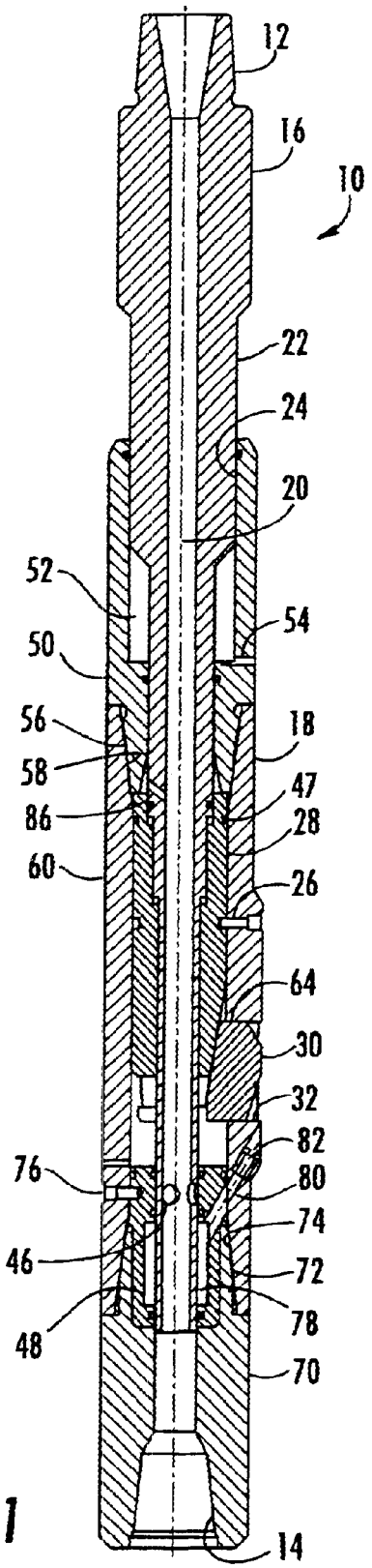
FIG. 1 is a sectional view of an underreamer in accordance with a preferred embodiment of the present invention, shown in an initial configuration for running into or from a bore.

Reference is first made to FIG. 1 of the drawings, which illustrates a downhole tool in the form of an underreamer 10 in accordance with a preferred embodiment of the present invention. The underreamer 10 is intended for mounting on the lower and of a drill string, and thus has a pin connection 12 for coupling to the lower end of the drill string, and a box connection 14 for coupling to a drill bit.

The underreamer 10 comprises a mandrel 16 for coupling to the lower end of the drill string, the mandrel 16 extending into a tubular body 18 for coupling to the drill bit. The mandrel 16 and body 18 collectively define a central through bore 20 to allow passage of drilling mud to the drill bit. The mandrel 16 and body 18 are rotatably coupled by means of a hexagonal male portion 22 on the mandrel engaging a female hexagonal portion 24 on the body. The mandrel 16 and body 18 are also axially relatively movable, however initially a shear pin 26 prevents such relative axial movement.

The mandrel 16 steps downwardly in cross-section as it extends through the body 18, and provides mounting for a cam sleeve 28 which is threaded to the mandrel 16 and co-operates with three extendable members in the form of cutters 30 mounted in respective body ports 32. The cam sleeve 28 is illustrated in greater detail in FIGS. 3 and 4 of the drawings, and it will be noted that the three cam surface portions 34, 35, 36 each carry a respective dovetail profile 38, 39, 40. Each cutter 30, one of which is shown in greater detail in FIGS. 5 and 6 of the drawings, defines a corresponding dovetail slot 42, to positively engage the respective dovetail profile.

As most clearly seen in FIG. 3, the lower end of the cam sleeve is generally triangular in cross-section, while the upper section of the cam sleeve 28 is cylindrical, and defines annular grooves 44, 45 to engage with the shear pin 26 and to accommodate a seal 47, respectively.

The lower end of the mandrel 16 is in the form of an elongate tube, in sliding sealing engagement with the body 18, the tube defining a number of ports. 46 which are initially closed by a body-mounted cam stop 48.

The body 18 comprises a top sub 50 which defines the hexagonal female portion 24 and which, in the underreamer initial configuration as illustrated in FIG. 1, defines a volume 52 to accommodate axial movement of the mandrel 16 into the body 18. Initially, the volume 52 is filled with grease, injected through a port 54. The top sub 50 includes a threaded pin 56 which engages a corresponding box 58 defined by the upper end of a main portion 60 of the body 18. The body portion 60 defines the cutter ports 32, the ports 32 being rectangular and equally spaced at 120° intervals around the body.

Figure 5:
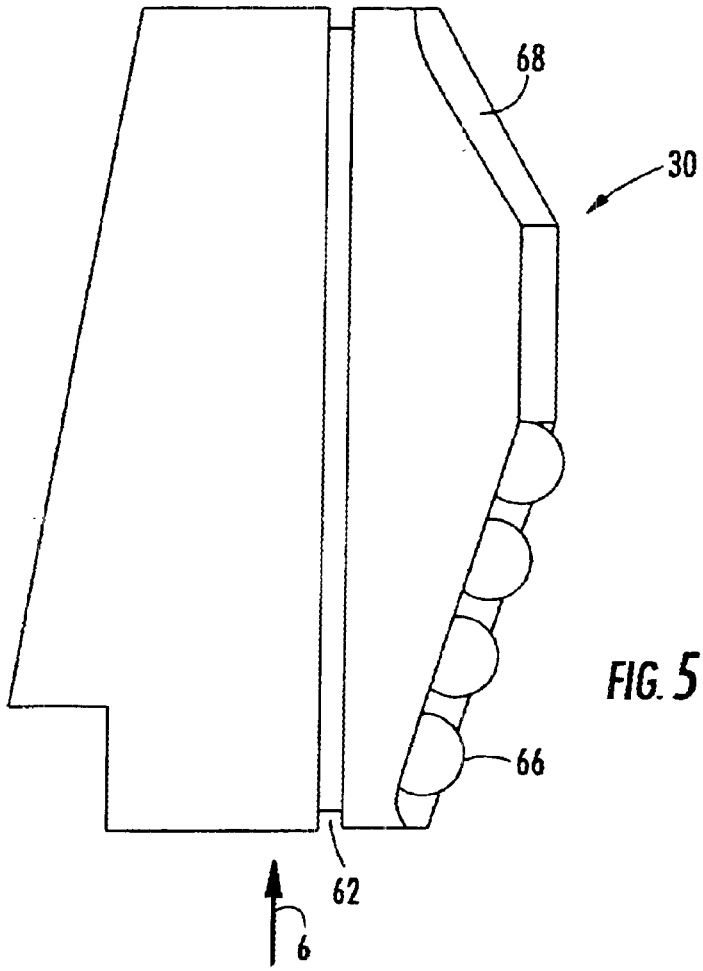
FIG. 5 is an enlarged end view of a cutter of the underreamer of FIG. 1.
Figure 6:
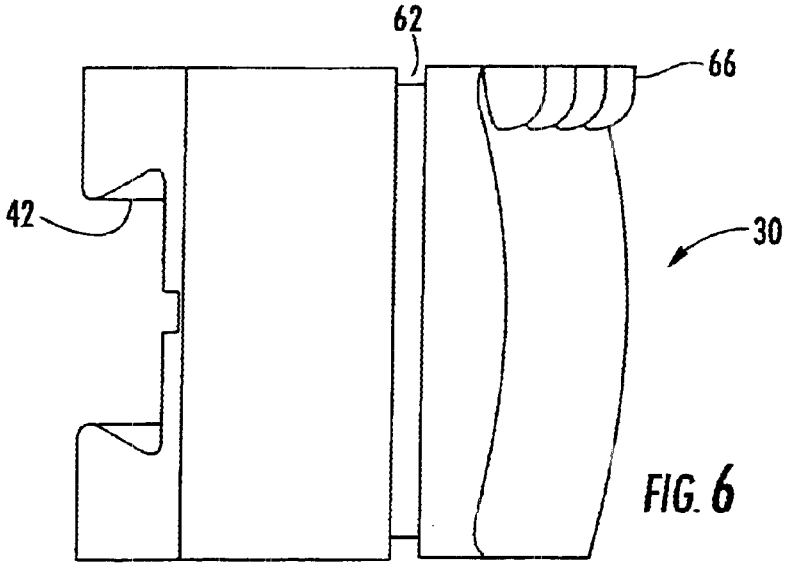
FIG. 6 is a view from below of the cutter of FIG. 5, taken in the direction of arrow 6 of FIG. 5.
Figure 7:
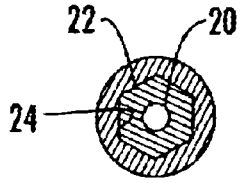
FIG. 7 is a sectional view on line 7—7 of FIG. 2.

As may be seen from FIGS. 5 and 6 of the drawings, each cutter 30, for location in a respective port 32, defines a peripheral slot 62 to accommodate an O-ring 64 (FIG. 1) to sealingly engage the port wall. Further, the leading lower edge of each cutter carries hardened cutting inserts 66 if desired. The upper leading cutter edge 68 may also define a cutting face, to facilitate back-reaming.

A bottom sub 70 defining a threaded pin 72 engages a corresponding box 74 on the lower end of the main body 60, the cam stop 48 being secured between the bottom sub 70 and the main body 60 and held against rotation by a pin 76 extending through the lower end of the body 60. The cam stop 48 defines an annular chamber 78 around the lower and of the mandrel 16, and conduits 80 extend from the chamber 78 upwardly through the cam stop 48 and main body 60, to exit below the cutter 30, each conduit 80 being provided with a nozzle insert 82.

Figure 2:
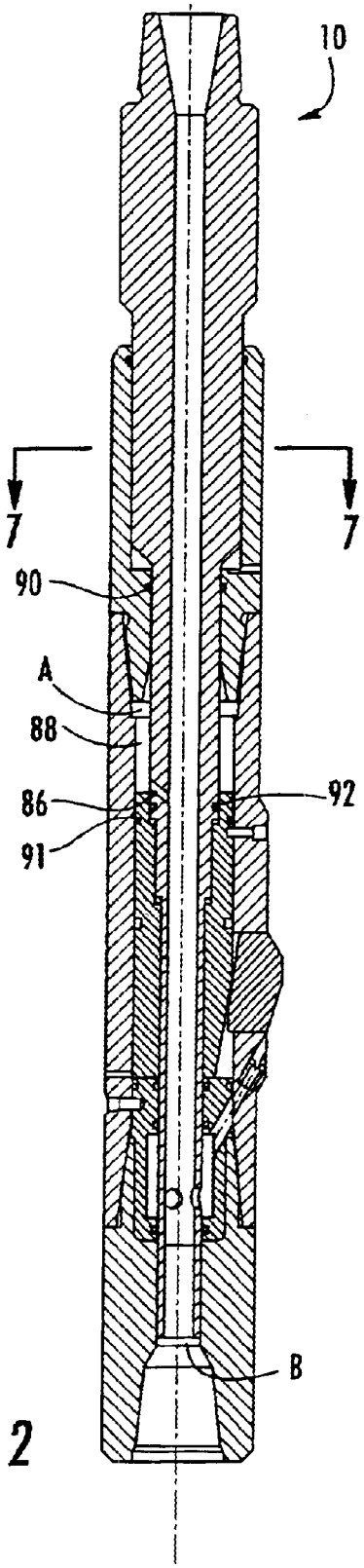
FIG. 2 corresponds to FIG. 1, but illustrates the underreamer in a cutting configuration.

In use, the underreamer 10 is mounted on the lower end of a drill string, with the drill bit coupled to the lower end of the body 18. The underreamer 10 and bit are run through a length of existing casing, and the drill bit may be used to drill through the casing shoe. Drilling may then continue beyond the end of the casing until at least the cutters 30 are located below the end of the casing. If sufficient additional weight is applied to the string at this point, the pin 26 will shear, allowing the mandrel 16 to move downwardly into the body 18, the cam sleeve 28 acting to push the cutters radially outwardly, to the configuration as illustrated in FIG. 2 of the drawings. In addition, a pressure port 86 extends between the through bore 20 and a volume 88 between the mandrel 16 and body 18, the volume 88 being isolated by seals 90, 91, 92. The fluid pressure acting within the volume 88 serves to create a pressure force, which is a function of the differential between tool internal pressure and annulus pressure, multiplied by the difference between area A and area B. This force tends to lift the body 11 on the mandrel 16, thus also contributing to the extension of the cutters 30, On the mandrel 16 moving into the body 18, the mandrel ports 46 are moved into communication with the cam stop chamber 78, allowing drilling mud to flow, from the underreamer through bore 20, through the nozzles 82. This creates a pressure drop in the tool internal pressure, which is detectable at the surface and provides a positive indication that the cutters 30 have been extended.

On rotation of the drill string, the underreamer will rotate and, following the drill bit, ream the drilled bore to a diameter corresponding to the outer diameter described by the extended cutters 30.

On making up the mandrel 16 to the cam sleeve 28 during assembly of the tool the connecting thread is not fully made-up. Accordingly, when torque is applied to the mandrel 16, the available "free play" between the mandrel 16 and the cam sleeve 28 prevents any substantive torque being applied to the cam sleeve 28, and thus transferred to the cutters 30; in the absence of such an arrangement it is possible that the cams and cutters would bind, or the cutters 30 would bind in the ports 32.

If the drill bit is passing through a relatively soft formation, it may be difficult to apply significant weight to the bit. However, au the mandrel 16 and body 18 are movable to extend the cutters under the influence of both weight and fluid pressure, the cutters will remain extended in this situation.

When the drilling and reaming operation is concluded, and the bit is lifted off bottom and the mud pumps turned off, the mandrel 16 will tend to be pulled from the body 18. As the cam sleeve 28 positively engages the cutters 30, this results in the cutters being positively withdrawn, rather than relying on externally applied forces. However, if the cutters 30 do not withdraw, for example the mandrel and body do not separate axially under the influence of the body and bit mass, and the underreamer 10 is lifted with the cutters 30 extended, on the underreamer encountering a bore restriction, such as the bottom of a section of existing casing, the cutters 30 will engage the casing and cause tension to be applied between the mandrel and body, which tension will cause the mandrel 16 to be pulled from the body 18 and the cutters 30 retracted.

Extension and retraction of the cutters 30 is closely controlled by the presence of the dovetail profiles and slots on the cam sleeve 28 and cutters 30, and there is little if any opportunity for the cutters 30 to become cocked and thus jammed in the respective body ports 32.

From the above description it will be apparent to those of skill in the art that the above-described underreamer overcomes many of the disadvantages of existing underreamers.

It will further be apparent to those of skill in the art that the above-described embodiment is merely exemplary of the present invention, and that various modifications and improvements may be made thereto, without departing from the scope of the invention. For example, one or more aspects of the present invention may also be usefully employed in other downhole tools, such as expandable stabilisers.

What is claimed is:

1. A downhole cutting tool for mounting between first and second sections of a drill string, the tool comprising:

a mandrel for coupling to a first section of drill string;

a body axially movably mounted on the mandrel and for coupling to a second section of drill string whereby application of weight to the string induces axial movement of the body relative to the mandrel;

fluid pressure responsive means for moving the body axially relative to the mandrel on application of a fluid pressure force between the body and mandrel; and at least one linearly radially extendable cutter mounted in the body and being operatively associated with the mandrel such that relative axial movement of the mandrel and body induces radial movement of the cutter, whereby application of weight to the string induces linear radial extension of the cutter.

2. The tool of claim 1, wherein the body defines an aperture to accommodate the cutter.

3. The tool of claim 1, wherein a plurality of cutters are provided.

4. The tool of claim 3, wherein the tool is provided with three cutters which retract and expand in unison.

5. The tool of claim 1, wherein the mandrel and body define a throughbore to permit drilling fluid to pass therethrough.

6. The tool of claim 5, wherein a conduit extends from the throughbore to permit fluid to be directed towards the cutter.

7. The tool of claim 6, wherein the conduit is initially closed, and is opened by relative movement of the mandrel and body resulting in extension of the cutter.

8. The tool of claim 1, wherein the mandrel and body are rotatably coupled, the coupling permitting axial movement therebetween.

9. The tool of claim 8, wherein the coupling is formed of co-operating hexagonal parts.

10. The tool of claim 1, wherein the mandrel defines a cam surface for co-operating with an inner face of the cutter.

11. The tool of claim 10, wherein a portion of the mandrel coupled to the drill string and a portion of the mandrel defining the cam surface are separable, and are coupled by cooperating screw threads.

12. The tool of claim 1, wherein the mandrel and body are initially releasably fixed relative to one another to permit manipulation of the string without activation of the tool.

13. A downhole cutting tool for mounting between first and second sections of a drill string, the tool comprising:

a mandrel for coupling to a first section of drill string;

a body axially movably mounted on the mandrel and for coupling to a second section of drill string whereby application of weight to the string induces axial movement of the body relative to the mandrel;

fluid pressure responsive means for moving the body axially relative to the mandrel on application of a fluid pressure force between the body and mandrel; and a radially extendable cutter mounted in the body and being operatively associated with the mandrel such that relative axial movement of the mandrel and body induces radial movement of the cutter, the mandrel including means for drawing the cutter inwardly to permit positive retraction of the cutter from an extended configuration.

14. A downhole cutting tool for mounting on a drill string, the tool comprising:

a mandrel;

a body axially movably mounted on the mandrel; and at least one radially extendable cutter mounted in the body and being operatively associated with the mandrel such that relative axial movement of the mandrel and body induces radial movement of the cutter, application of axial tension to the tool producing axial movement of the body relative to the mandrel tending to retract the cutter from an extended configuration, wherein the mandrel and body define a throughbore to permit drilling fluid to pass therethrough, a conduit extends from the throughbore to permit fluid to be directed towards the cutter and wherein the conduit is initially closed and is opened by relative movement of the mandrel and body resulting in extension of the cutter.

15. A downhole cutting tool for mounting on a drill string, the tool comprising:

a mandrel;

a body axially movably mounted on the mandrel; and at least one radially extendable cutter mounted in the body and being operatively associated with the mandrel such that relative axial movement of the mandrel and body induces radial movement of the cutter, application of axial tension to the tool producing axial movement of the body relative to the mandrel tending to retract the cutter from an extended configuration, wherein the mandrel and body are rotatably coupled, the coupling permitting axial movement therebetween, and wherein the coupling is formed of co-operating hexagonal parts.

16. A downhole cutting tool for mounting on a drill string, the tool comprising:

a mandrel;

a body axially movably mounted on the mandrel; and at least one radially extendable cutter mounted in the body and being operatively associated with the mandrel such that relative axial movement of the mandrel and body induces radial movement of the cutter, application of axial tension to the tool producing axial movement of the body relative to the mandrel tending to retract the cutter from an extended configuration, wherein the mandrel and body are initially releasably fixed relative to one another to permit manipulation of the string without activation of the tool.

* * * * *